US006118877A

United States Patent [19]

Lindemann et al.

[11] Patent Number: 6,118,877

[45] Date of Patent: Sep. 12, 2000

[54] HEARING AID WITH IN SITU TESTING CAPABILITY

[75] Inventors: Eric Lindemann; John L. Melanson, both of Boulder, Colo.

[73] Assignee: AudioLogic, Inc., Boulder, Colo.

[21] Appl. No.: 08/542,156

[22] Filed: Oct. 12, 1995

[51] Int. Cl.[7] ..... H04R 29/00

[52] U.S. Cl. ..... 381/60; 381/23.1; 381/312

[58] Field of Search ..... 381/58, 60, 68.2, 381/68.4, 23.1, 312, 314, 317, 320, 328, 322; 73/585; 607/57

[56] References Cited

U.S. PATENT DOCUMENTS

| | | | |
|---|---|---|---|
| 3,818,149 | 6/1974 | Stearns | 381/68.4 |
| 4,471,171 | 9/1984 | Kopke et al. | 179/107 R |
| 4,711,243 | 12/1987 | Schafer | 607/57 |
| 4,759,070 | 7/1988 | Voroba et al. | 381/60 |
| 4,862,505 | 8/1989 | Keith | 381/60 |
| 5,197,332 | 3/1993 | Shennib | 73/585 |
| 5,233,665 | 8/1993 | Vaughn | 381/68.2 |
| 5,384,852 | 1/1995 | Scharen | 381/68 |
| 5,794,201 | 8/1998 | Nejime et al. | 704/267 |

FOREIGN PATENT DOCUMENTS

| | | | |
|---|---|---|---|
| 0 661 905 A2 | 3/1995 | European Pat. Off. | H04R 25/00 |
| WO 94/22276 | 9/1994 | WIPO | H04R 25/00 |
| WO 96/03848 | 2/1996 | WIPO | H04R 25/00 |

OTHER PUBLICATIONS

Denis Byrne et al., "The National Acoustic Laboratories' (NAL) New Procedure for Selecting the Gain and Frequency Response of a Hearing Aid," *Ear and Hearing*, vol. 7, No. 4, 1986, The Williams & Wilkins Co., pp. 257–265.

Fred Waldhauer et al., "Full Dynamic Range Multiband Compression in a Hearing Aid," *The Hearing Journal*, Sep. 1988, The Laux Co., Inc., pp. 1–4.

"Programmable Analog Signal Processor, GP520A Advance Information Note", Gennum Corporation. pp. 89–98.

*Primary Examiner*—Curtis A. Kuntz
*Assistant Examiner*—Duc Nguyen
*Attorney, Agent, or Firm*—Fenwick & West LLP

[57] ABSTRACT

A hearing aid has a built in or internal test tone generator for providing test tones and noise for diagnostic tests to a user through the receiver of the hearing aid. Alternatively an external test tone generator may be coupled to the hearing aid and selectively coupled to the receiver of the hearing aid for the diagnostic tests. A memory internal to the hearing aid may store real world sounds for diagnostic tests to simulate actual usage of the hearing aid.

4 Claims, 2 Drawing Sheets

HEARING AID WITH IN SITU TESTING CAPABILITY

RELATED APPLICATION

The subject matter of this application is related to the subject matter of patent application Ser. No. 08/907,337 entitled "Digital Signal Processing Hearing Aid" filed on Oct. 10, 1995 by Eric Lindemann & John Melanson.

FIELD OF THE INVENTION

This invention relates to hearing aids, and more particularly to hearing aids having the capability of in situ testing.

BACKGROUND OF THE INVENTION

Hearing aid fitting is a process of adjusting the overall gain, the frequency response, and dynamic processing parameters of an electronic hearing instrument to best match the requirements of an individual user. The fitting process is generally carried out by a hearing professional, such as an audiologist, an ear, nose, and throat doctor, or a hearing aid dispenser. Hearing aid fitting is usually based on a number of diagnostic tests which are performed as part of, or prior to the fitting session. These diagnostic tests may include a threshold audiogram, and tests to establish the most comfortable (MCL) and uncomfortable (UCL) listening levels in different frequency bands. These tests are usually administered using standard audiometers which present pure test tones and bands of noise at different frequencies and different amplitudes. These sounds are presented to the test subject through headphones or in free space from loudspeakers. The test subject responds to the presentation sounds by indicating whether the sound is barely audible, as in the case of threshold tests, or with a judgment about the loudness of a sound, as in the case of the MCL and UCL tests.

The result of these diagnostic tests is often a prescription for a hearing aid having an insertion gain (IG) which specifies the desired frequency dependent gain that a hearing aid delivers to provide maximum satisfaction for the hearing aid user.

Some hearing aids provide dynamic range compression in which the gain applied in a given frequency band can be a function of the amount of power in that frequency band. This may be viewed as different insertion gains for different input power levels. Compressing hearing aids have a number of time constants which determine how quickly the insertion gain changes as a function of changes of input power level. A prescription for a compressing hearing aid may include multiple frequency dependent insertion gains or a formula for modifying a single frequency dependent insertion gain based on input power—compression ratios are a way to express this—and associated compression time constants.

A number of formulae have been devised which receive as input the result of a set of diagnostic tests and produce as an output a hearing aid prescription. An example of this is the Australian National Acoustics Laboratory (NAL) formula for noncompressing aids. Systems for fitting compressing aids from loudness judgment test data are described in Fred Waldhauer et al., "Full Dynamic Range Multiband Compression In A Hearing Aid", *The Hearing Journal*, September 1988, at 1–4 and U.S. Pat. No. 4,718,499.

Given a hearing aid prescription, an important goal of the fitting session is to adjust the hearing aid to achieve the prescription. A limitation of performing this adjustment is that the frequency response and gain of a hearing aid can only really be determined when it is plugged into the ear.

This is because the ear canal, eardrum, the degree to which the hearing aid seals the ear canal, and variations from one hearing aid device to another, all affect the frequency response of the aid. To overcome this limitation the hearing aid fitter often uses a probe microphone which is a microphone in the form of a very fine flexible tube which can be inserted into the ear canal with the tip of the tube placed near the eardrum while the hearing aid is in place. The probe microphone then measures the energy present at the eardrum. Another microphone is generally placed just outside the ear to determine the energy arriving at the input of the hearing aid. With these two measurements, the overall gain and frequency response characteristics of the hearing aid can be determined.

The probe microphone measurement approach to hearing aid fitting is susceptible to various causes of measurement errors. These include pinching of the probe microphone tube, variability in placement of the tip of the tube in relation to the eardrum, and plugging of the tube with earwax, dirt or debris. These problems make probe tube measurements difficult and time consuming.

Even if the hearing aid prescription has been successfully implemented, there is still no guarantee that the hearing aid has been adjusted for maximum satisfaction. This is because the formulae which have been used to determine the hearing aid prescription cannot account for the myriad subjective factors which govern hearing aid acceptance. As a result, after implementation of a hearing aid prescription, the fitting session may continue with the hearing aid fitter applying a number of artful manual readjustments of the hearing aid response. To aid in this process, the hearing aid fitter often presents a selection of real world sounds which the test subject listens to through loudspeakers in an attempt to simulate various listening environments. The hearing aid fitter then interrogates the subject about the quality of the sounds and uses the responses as a guide to further readjustment.

A problem relating to this readjustment process is that presentation of sounds through loudspeakers must be done in a controlled and repeatable way so that, for example, sounds which are supposed to be perceived as being at conversational level are indeed presented at this level. This means that the placement of the loudspeakers, the amplification system, and the distance and orientation of the subject in relation to the loudspeakers all must be properly controlled.

It is desired to have a hearing aid that alleviates the problems associated with traditional fitting using probe microphones and external loudspeakers.

SUMMARY OF THE INVENTION

In the present invention, a hearing aid generates the diagnostic test tones and the sounds to simulate a real listening environment. The hearing aid generates such tones and sounds in situ.

The hearing aid includes a microphone, a hearing rehabilitator for processing an audio signal from the microphone, and including a receiver. A tone generator coupled to the receiver produces tones for diagnostic tests. The tone generator may vary gain and the frequency shaping of the test tones responsive to user selected commands. A switch selectively couples either the hearing rehabilitator or the tone generator to the receiver. A memory stores recordings of real world sounds, which are retrieved by a controller and provided to a digital-to-analog converter, which converts the recordings into an analog audio signal. The switch also selectively couples the digital-to-analog converter to the receiver.

A hearing aid comprises a microphone for providing an electrical signal in response to sounds and comprises a receiver. A digital-to-analog converter receives a digital audio signal and provides an analog audio signal to the receiver in response to the digital audio signal. A programmable digital signal processor selectively executes either a hearing rehabilitation program to alter the electrical signal or a test tone generation program for producing tones for diagnostic tests. The digital signal processor provides the digital audio signal to the digital-to-analog converter in response to either the altered electrical signal or the tones. The programmable digital signal processor retrieves stored recordings of sounds from a memory and provides such stored recordings to the digital-to-analog converter. The programmable digital signal processor varies the gain and the frequency shaping of the test tones responsive to a control signal.

A hearing aid comprises a microphone, a hearing rehabilitator for processing an audio signal from the microphone, and including an input port for receiving test tones for diagnostic tests from an external sound source. An amplifier amplifies the test tones. A receiver provides a sound signal in response to the amplified test tones. A switch selectively couples either the hearing rehabilitator or the input port to the amplifier to provide audio signals indicative of the sounds detected by the microphone or of the test tones generated externally. The test tones may be analog or digital. For digital test tones, the hearing aid further comprises an digital-to-analog converter for converting the digital test tones into an analog audio signal.

DETAILED DESCRIPTION OF THE PREFERRED EMBODIMENTS

Figure 1:
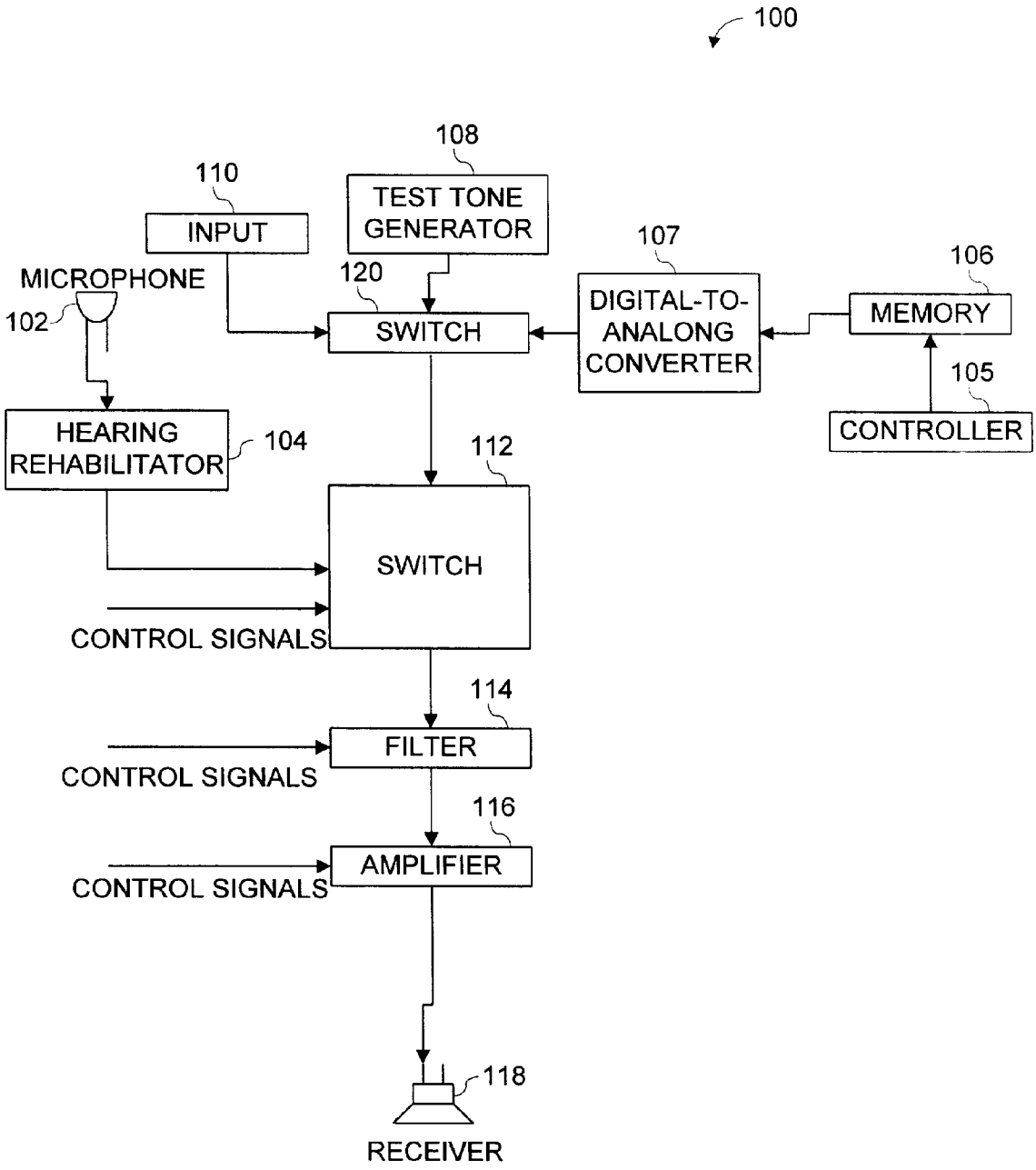
FIG. 1 is a block diagram illustrating a hearing aid in accordance with the present invention.

Referring to FIG. 1, there is shown a block diagram illustrating a hearing aid 100 in accordance with the present invention. The hearing aid 100 provides test tones to a user for in situ testing and adjustments of the hearing aid.

The hearing aid 100 comprises a microphone 102, a hearing rehabilitator 104, a controller 105, a memory 106, a digital-to-analog converter 107, a test tone generator 108, an input port 110, a switch 112, a filter 114, an amplifier 116, a receiver 118, and a switch 120. In a normal hearing aid mode, the hearing aid wearer hears sounds from the external environment. In this mode, the microphone 102 receives sounds from the external environment and provides an analog audio signal indicative of the sounds to the hearing rehabilitator 104. The microphone 102 may be, for example, a conventional hearing aid microphone. The hearing rehabilitator 104 filters, amplifies, and dynamic range compresses the audio signal. The hearing rehabilitator 104 may be, for example, a programmable master hearing aid model GP520 manufactured by Gennum Corporation of Burlington, Ontario, Canada. The hearing rehabilitator 104 provides the processed audio signal to the switch 112, which selectively provides the processed signal to the filter 114 to allow the hearing aid 100 to detect sounds from the external environment.

The filter 114 provides a filtered audio signal to the amplifier 116 which amplifies the filtered audio signal. The characteristics of the filter 114 may be dynamically controlled to alter the frequency content of the audio signal in response to control signals from the hearing aid fitter. The receiver 118 converts the amplified audio signal into sound which is provided to the user. The receiver 118 may be, for example, a conventional hearing aid receiver. The term "receiver" as used in the art of hearing aids refers to a hearing aid speaker.

In a diagnostic test mode, the hearing aid fitter adjusts the operational characteristics of the hearing aid to match the particular need of the wearer. The hearing aid fitter may select from either an internal test mode or an external test mode. In the external test mode, the test tones and sounds are received through the input port 110. In the internal test mode, the test tones are generated by the test tone generator 108 in a test tone generation mode and the real world sounds are generated by retrieving the recorded sounds from the memory 106 in a sampled tone mode. In the diagnostic test mode, the switch 112 selectively couples the switch 120 to the filter 114 to provide either internally or externally generated sounds to the user.

In the test tone generation mode, the test tone generator 108 provides tones and noise for diagnostic tests of the hearing aid 100 to the switch 120 and to the switch 112, which provides the tones and noise to the filter 114 for processing as described above. The tones are synthesized tones such as a sine wave having a single controlled frequency, a composite sinewave, band limited noise, or another audio signal. The test tone generator 108 may vary the gain and the frequency shaping of the test tones responsive to user selected signals. The noise may be narrow band noise.

In the external test generation mode, the input port 110 receives tones and noise for diagnostic tests from an external source (not shown), such as an external test tone generator, audiometer, tape recorder, compact disk player, or other sound source, which are provided to the switches 120 and 112. The input port 110 also may be used for receiving recordings of real world sounds from a tape, compact disk, or the like. In an alternate embodiment, the hearing aid 100 does not include the test tone generator 108 and provides the test tones received through the input port 110.

In the sampled tone mode, the memory 106 provides sampled real world sounds stored therein. The controller 105 sends addresses and control signals to the memory 106 to read the sampled real world sounds. In response, the memory 106 provides the read sampled real world sounds to the digital-to-analog converter 107, which converts the sampled real world sounds into an analog audio signal that is provided to the switch 120 and then to the switch 112. The memory 106 is preferably a nonvolatile memory. The memory 106 may be, for example, a conventional electrically erasable programmable read only memory (EEPROM). The sounds may be stored in the memory 106 in a compressed form. In an alternate embodiment, the hearing aid 100 does not include the memory 106 and receives the real world sounds through the input port 110.

Having described the hearing aid 100, the diagnostic tests are now described. One diagnostic test is the pure tone threshold audiogram test. In this test, the hearing aid fitter asks the subject to determine at which amplitude level a set of pure tones of varying frequencies—approximately 100 Hz to 6000 Hz—become just barely audible. This establishes the frequency dependent threshold of hearing for the subject. The results of this test are plotted as an audiogram which displays the hearing loss relative to a normal non-impaired listener. The purpose of the audiogram in hearing aid fitting is that it permits the determination of an insertion gain. The insertion gain is the gain required to amplify tones at or somewhat above the normal threshold of hearing to a level which is at the threshold of the impaired listener.

With conventional fitting practices, the insertion gain is first determined with audiometric equipment, then probe microphones are used to verify that the hearing aid is delivering the desired gain. For the hearing aid 100, an in situ testing approach is used, in which the hearing aid 100 directly generates pure tones, such as a sinewave. In particular, the test tone generator 103 generates such tones. To determine the actual frequency dependent gain of the hearing aid 100, i.e. the set of parameter adjustments needed so that the hearing aid implements the desired insertion gain, the gain of the hearing aid 100 is increased in various bands until the tones become barely audible. In particular, the gain of the amplifier 116 is adjusted in the various frequency bands. Thus, no probe microphone technology is needed. This results in a more reliable fitting and at a reduced cost to the hearing aid fitter because a probe microphone system is not required.

A second diagnostic test is a loudness scaling approach to fitting. This test is similar to the pure tone threshold audiogram test. In this test, sounds—usually narrow bands of noise—are played at various frequencies and amplitudes and the hearing aid fitter asks the test subject to rate these sounds according to a loudness scale. The loudness scale may be, for example, very soft, soft, comfortable, loud, and very loud. Based on the subject's responses and the known responses of an averaged set of normal subjects, it is possible to determine a frequency and amplitude dependent gain map for the test subject, i.e., the gain at which the hearing impaired subject associates a test noise at a given frequency and power level with the same loudness category that the normal subject would. In other words, after application of the gain, soft sounds sound soft, loud sounds sound loud, and so forth.

A conventional loudness test uses audiometric equipment to generate a gain map—a set of insertion gains or a single insertion gain and a set of compression ratios. The hearing aid then is adjusted to implement this gain. This adjustment is performed using probe microphone measurement techniques.

In contrast, the hearing aid 100 directly generates the test noises using the test tone generator 108. The gain of the amplifier 116 is adjusted for each frequency band until the hearing impaired subject identifies the test noise as being in the correct loudness category. These gain adjustments are then applied to signals received during normal use of the hearing head. This simplifies the loudness test. Again no probe microphone equipment is necessary.

A third diagnostic test is a manual readjustment of the insertion gain for real world sounds. In this test, the hearing aid fitter generally plays real world sounds through loudspeakers and adjusts the gain and frequency response of the hearing aid for maximum clarity and comfort as determined by the subjective responses of the hearing aid wearer.

In the present invention, real world sounds can be played by the hearing aid 100 from signals received via the input port 108 from an external source (not shown) or from signals generated internally in the hearing aid 100 by retrieving the real world sounds stored in the memory 106. This eliminates the need for loudspeakers and their inherent problems of positioning the loudspeakers in relation to the hearing aid wearer and controlling the calibration of the loudspeaker amplification system.

Figure 2:
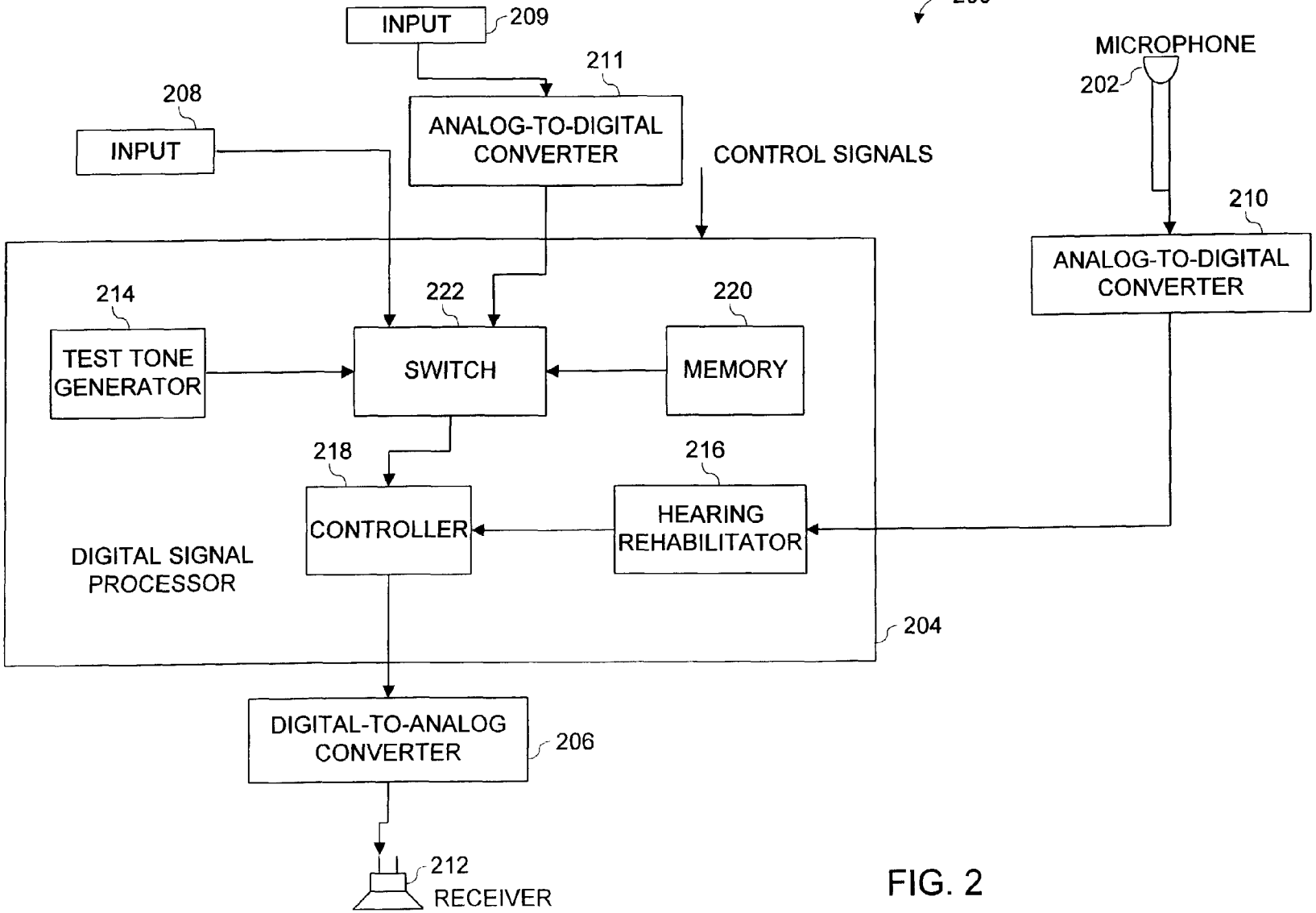
FIG. 2 is a block diagram illustrating a digital hearing aid in accordance with the present invention.

Referring to FIG. 2, there is shown a block diagram illustrating a digital hearing aid 200 in accordance with the present invention. The hearing aid 200 provides test tones to a user for in situ testing and adjustments of the hearing aid. The hearing aid 200 comprises a microphone 202, a programmable digital signal processor 204, a digital-to-analog converter 206, a digital input port 208, an analog input port 209, analog-to-digital converters 210 and 211, a receiver 212, and a switch 222. In a normal hearing aid mode, the microphone 202 receives sounds from the external environment and provides an analog audio signal indicative of the sounds to the analog-to-digital converter 210, which converts the analog audio signal to a digital audio signal. The microphone 202 may be, for example, a conventional hearing aid microphone. The analog-to-digital converter 210 provides the digital audio signal to a hearing rehabilitator 216 of the digital signal processor 204 for processing.

The digital signal processor 204 executes software programs for normal operation of the hearing aid 200 and for diagnostic tests. The digital signal processor 204 comprises a test tone generator 214 and the hearing rehabilitator 216. The test tone generator 214 is a computer program that generates a synthesized tone signal that is either a sinewave having a controlled frequency, band limited noise, composite sine waves, or other audio signals, and provides such a signal to a controller 218 for diagnostic tests of the hearing aid 200 in a test tone generation mode. The test tone generator 214 also may vary the gain and the frequency shaping of the test tones responsive to user selected signals. The hearing rehabilitator 216 is a computer program for filtering, amplifying, and dynamic range compressing the audio signal. The hearing rehabilitator 216 provides the processed audio signal to the controller 218. Such a hearing rehabilitator 216 is described in Fred Waldhauer et al., "Full Dynamic Range Multiband Compression In A Hearing Aid", *The Hearing Journal*, September 1988, at 1–4 and U.S. Pat. No. 4,718,499 for compression, described in U.S. patent application Ser. No. 08/123,503 entitled "Noise Reduction System for Binaural Hearing Aid" filed Sep. 17, 1993, inventors Lindemann et al., described in U.S. patent application Ser. No. 08/184,724 entitled "Dynamic Intensity Beamforming System for Noise Reduction in a Binaural Hearing Aid", filed Apr. 20, 1994, inventors Lindemann et al., and described in U.S. patent application Ser. No. 08/907,337 entitled "Digital Signal Processing Hearing Aid", filed Oct. 10, 1995, inventors John Melanson and Eric Lindemann, the subject matter of all is incorporated herein by reference.

In the diagnostic test mode, the controller 218 couples the switch 222 to the digital-to-analog converter 206. A memory 220 stores sampled real world sounds that are provided to the programmable switch 218. The digital signal processor 204 reads the sampled real world sounds from the memory 220 and provides the sounds to the switch 222 in a sampled tone mode. The memory 220 is preferably a nonvolatile memory. The memory 220 may be, for example, an EEPROM. The sounds may be stored in the memory 220 in a compressed form. The controller 218 decompresses the data. In an alternate embodiment, the hearing aid 200 does not include the memory 220 and receives the real world sounds through the input ports 208, 209.

In the external test generation mode, the switch 222 couples either the digital input port 208 or the analog-to-digital converter 211 to the controller 218. The digital input port 208 coupled to the digital signal processor 204 receives tones and noise in a digital format from an external source (not shown), such as an external test tone generator, audiometer, tape recorder, compact disk player, or other sound source. The digital input port 208 may be also used for receiving recordings of real world sounds from a tape, compact disk or the like. The digital data provided to the input port 208 may be a compressed digital audio stream. The digital signal processor 204 decompresses the digital audio stream. The analog input port 209 coupled to the analog-to-digital converter 211 receives tones and noise in an analog format from an external source (not shown). The analog-to-digital converter 211 converts the analog tones and noise into a digital format and provides the digital tones and noise to the digital signal processor 204. In an alternate embodiment, the hearing aid 200 does not include a tone generator 214 and provides the test tones received through the input port 208. In another alternate embodiment, the hearing aid 200 does not include the input port 208 or the input port 209 or both.

In response to control signals from the hearing aid fitter, the controller 218 selectively couples either the hearing rehabilitator 216 in the normal hearing aid mode or the switch 222 to the digital-to-analog converter 206 for using the hearing aid 200 in a diagnostic test mode. In response to control signals from the hearing aid fitter in the diagnostic test mode, the controller 218 commands the switch 222 to selectively couple either the analog-to-digital converter 211, the test tone generator 214, the input port 208, or the memory 220 to the controller 218 for diagnostic testing of the hearing aid 200 as described above. The controller 218 processes the digital audio signal by filtering the audio signal and adjustingthe amplitude of the audio signal as a function of frequency in response to control signals from the hearing aid fitter. The digital-to-analog converter 206 converts the digital audio signal into an analog audio signal, which is provided to the receiver 212 which then converts the analog audio signal into sound which is provided to the user. The receiver 212 may be, for example, a conventional hearing aid receiver.

Having described the hearing aid 200, the diagnostic tests are now described. The hearing aid 200 executes a pure tone threshold audiogram test in a manner similar to that described above for the hearing aid 100. The hearing aid fitter determines an audiogram as described above except that the test tone generator 214 generates the pure tones digitally. Further, the adjustments to the insertion gain in various bands are also performed digitally.

The hearing aid 200 executes a loudness scaling test in a manner similar to that described above for the hearing aid 100. The test tone generator 214 generates the narrow bands of noise digitally by reading the tables of sampled values of the sine waves for various frequencies and digitally adjusting the amplitude. The digital signal processor 204 generates a frequency and amplitude dependent gain map which is applied to received signals from the microphone to thereby provide the user with a sounds that vary according the loudness of the received signal at the microphone.

The hearing aid fitter performs manual readjustments to the hearing aid 200 to reflect real word sounds in a manner similar to that of the hearing aid 100. Such real world sounds may be received through the input port 208 or may be generated by the hearing aid 200. More specifically, the digital signal processor 204 reads from the table of sampled values of the real world sounds stored in the memory 220 and provides the sampled values to the digital-to-analog converter 206. The digital signal processor 204 adjusts the gain and the frequency response to improve clarity and comfort as determined by the subjective response of the hearing aid wearer.

We claim:

1. A hearing aid configured to be worn by a user and having in-situ testing capabilities for fitting the hearing aid to the user comprising:

a microphone;

hearing rehabilitator coupled to the microphone;

a receiver;

a tone generator for producing tones for in-situ diagnostic tests;

a memory for storing recordings of real world sounds in a digital format;

a controller coupled to the memory for retrieving the stored recordings of real world sounds;

a digital-to-analog converter coupled to the memory for converting the retrieved stored recordings into an analog audio signal; and a switch which selectively couples one of said hearing rehabilitator, said tone generator and said digital-to-analog converter to said receiver;

wherein said hearing aid is configured to be worn by a user at a location proximate to an ear of the user.

2. The hearing aid of claim 1 wherein the sounds are stored in the memory in a compressed form.

3. A hearing aid device configured to be worn by a user and having in-situ testing capabilities for fitting the hearing aid to the user, the device comprising:

a microphone;

a hearing rehabilitator coupled to the microphone;

test tone generator to generate test tones for in-situ testing to determine an insertion gain of the hearing aid suitable for the user;

an amplifier for generating amplified test tones;

a receiver, coupled to the amplifier, for providing a sound signal in response to the amplified test tones;

a switch for selectively coupling one of the hearing rehabilitator and means for generating test tones to the amplifier;

an adjuster, disposed to receive signals from said switch, for adjusting the gain of the amplifier in various frequency bands to fit the hearing aid device to the user;

a memory for storing recordings of real world sounds;

a controller coupled to the memory for retrieving the stored recordings of real world sounds; and a digital-to-analog converter coupled to the memory for converting the retrieved stored recordings into an analog audio signal;

the switch further selectively coupling the digital-to-analog converter to the receiver;

wherein said hearing aid is configured to be worn by a user at a location proximate to an ear of the user.

4. The hearing aid device of claim 3 further comprising:

an input port for receiving test tones for diagnostic test from an external sound source; and a switch coupled to the input port and the means for generating test tones.

* * * * *